US006530459B1

(12) United States Patent
Lu

(10) Patent No.: US 6,530,459 B1
(45) Date of Patent: Mar. 11, 2003

(54) HANDLE STRUCTURE FOR ADJUSTING DIRECTION

(75) Inventor: Lien Ching Lu, Miaoli Hsien (TW)

(73) Assignee: Ting Cheng Co., Ltd., Miaoli Hsien (TW)

( * ) Notice: Subject to any disclaimer, the term of this patent is extended or adjusted under 35 U.S.C. 154(b) by 0 days.

(21) Appl. No.: 10/028,674

(22) Filed: Dec. 28, 2001

(51) Int. Cl.[7] ..... A45C 13/00
(52) U.S. Cl. ..... 190/115; 16/900; 16/114.1
(58) Field of Search ..... 190/115, 117, 190/118, 18 R; 16/900, 429, 113.1, 114.1, 405; 280/655, 655.1, 47.371

(56) References Cited

U.S. PATENT DOCUMENTS

| | | | | | |
|---|---|---|---|---|---|
| 5,713,441 | A | * | 2/1998 | Chen | 190/115 |
| 5,884,362 | A | * | 3/1999 | Tsai | 16/113.1 |
| 6,009,598 | A | * | 1/2000 | Chang | 16/113.1 |
| 6,301,746 | B1 | * | 10/2001 | Myers et al. | 16/113.1 |
| 6,317,924 | B1 | * | 11/2001 | Gallagher | 16/114.1 |
| 6,332,242 | B1 | * | 12/2001 | Chen | 16/113.1 |
| 6,409,207 | B1 | * | 6/2002 | Kuo | 280/655.1 |

OTHER PUBLICATIONS

Kuo, U.S. 2002/0014382 A1, Feb. 7, 2002.*
Kuo, U.S. 2001/0040080 A1, Nov. 15, 2001.*

* cited by examiner

*Primary Examiner*—Lee Young
*Assistant Examiner*—Lien Ngo
(74) *Attorney, Agent, or Firm*—Rosenberg, Klein & Lee

(57) ABSTRACT

A handle structure for adjusting directions of a luggage handle includes a handle located on the top end of the luggage to fasten to the extensible pulling bars of the luggage. The handle consists of a front frame and a rear frame coupling to form a handle section. In the handle section, a depressing member is provided which has a bottom to contact a push stem. The push stem is formed in an inverse T shape. The push stem is housed in an anchor seat which consists of an upper seat and a lower seat. The upper seat has a retain trough to engage with the push stem. The anchor seat also has a depressing plate which has two ends located above two openings of the lower seat to contact control bars of a control element. Depressing the push button of the depressing member, the push stem may be disengaged from the retain trough of the anchor seat to allow the handle turning to an angle or direction desired. Releasing the depressing member, the push stem will be engaged with the retain trough again to anchor the handle at the selected angle or direction.

5 Claims, 8 Drawing Sheets

HANDLE STRUCTURE FOR ADJUSTING DIRECTION

BACKGROUND OF THE INVENTION

1. Field of the Invention

The invention relates to a handle structure for adjusting direction and particularly a handle adapted for use on luggage and is capable of adjusting direction.

2. Description of the Prior Art

The commonly used luggage or trunks generally have a handle which is fixedly mounted in one direction (mostly in parallel with the luggage). It is not flexible and cannot meet different requirements of consumers. The luggage thus made have functional deficiency and lack competitiveness on the market. There are still rooms for improvement.

SUMMARY OF THE INVENTION

In view of aforesaid disadvantages, it is a primary object of the invention to provide a handle that is adjustable to various directions.

The handle according to the invention includes a handle section which consists of a front frame and a rear frame, and a depressing member located in the handle section. The depressing member has a bottom to contact a push stem which is formed in an inverse T shape. The push stem is housed in an anchor seat which consists of an upper seat and a lower seat. Through the push stem, the handle may be turned on the anchor seat thereby to change and adjust the direction and angle of the handle.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
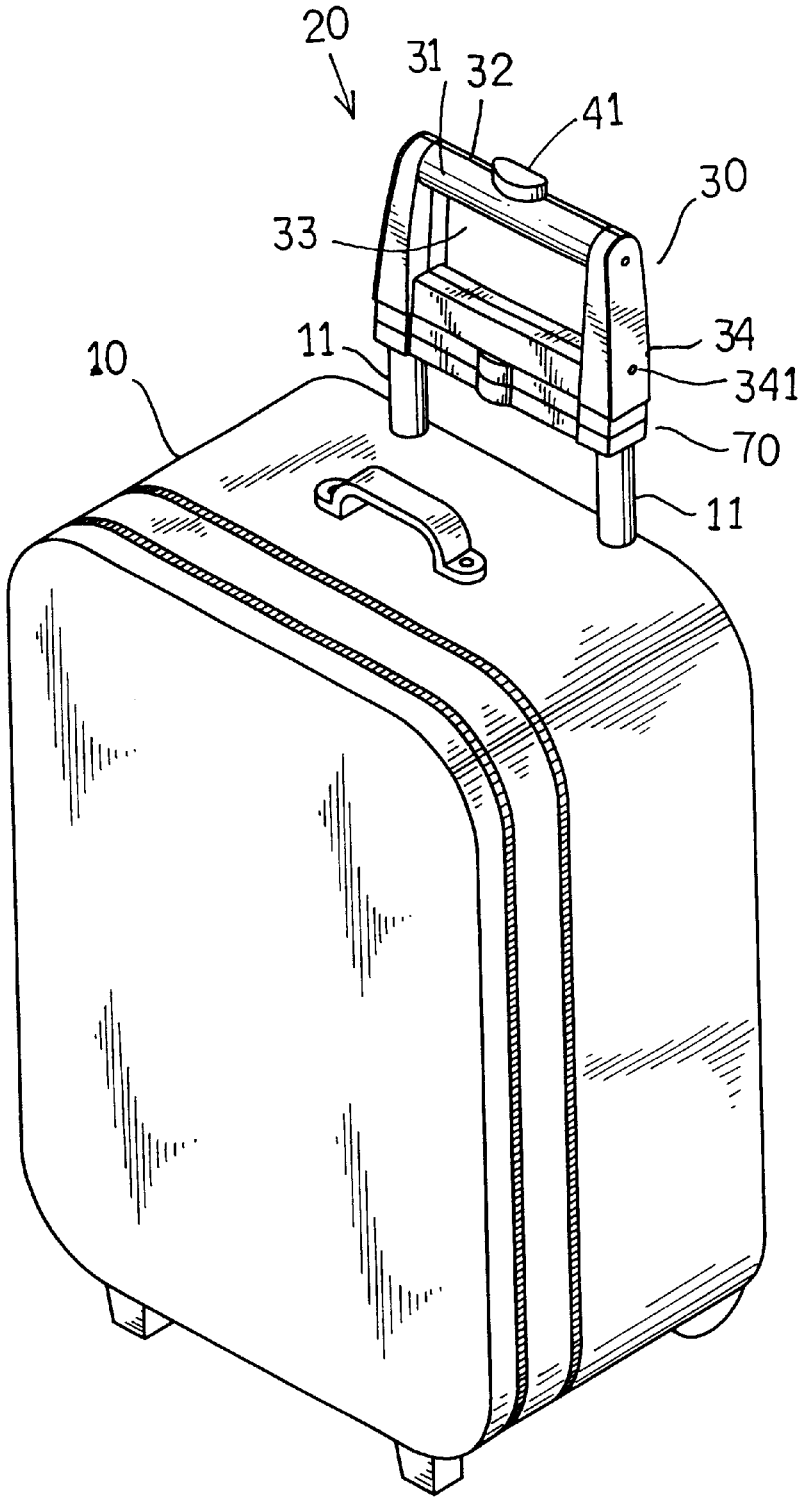
FIG. 1 is a perspective view of the invention adapted to a luggage.
Figure 2:
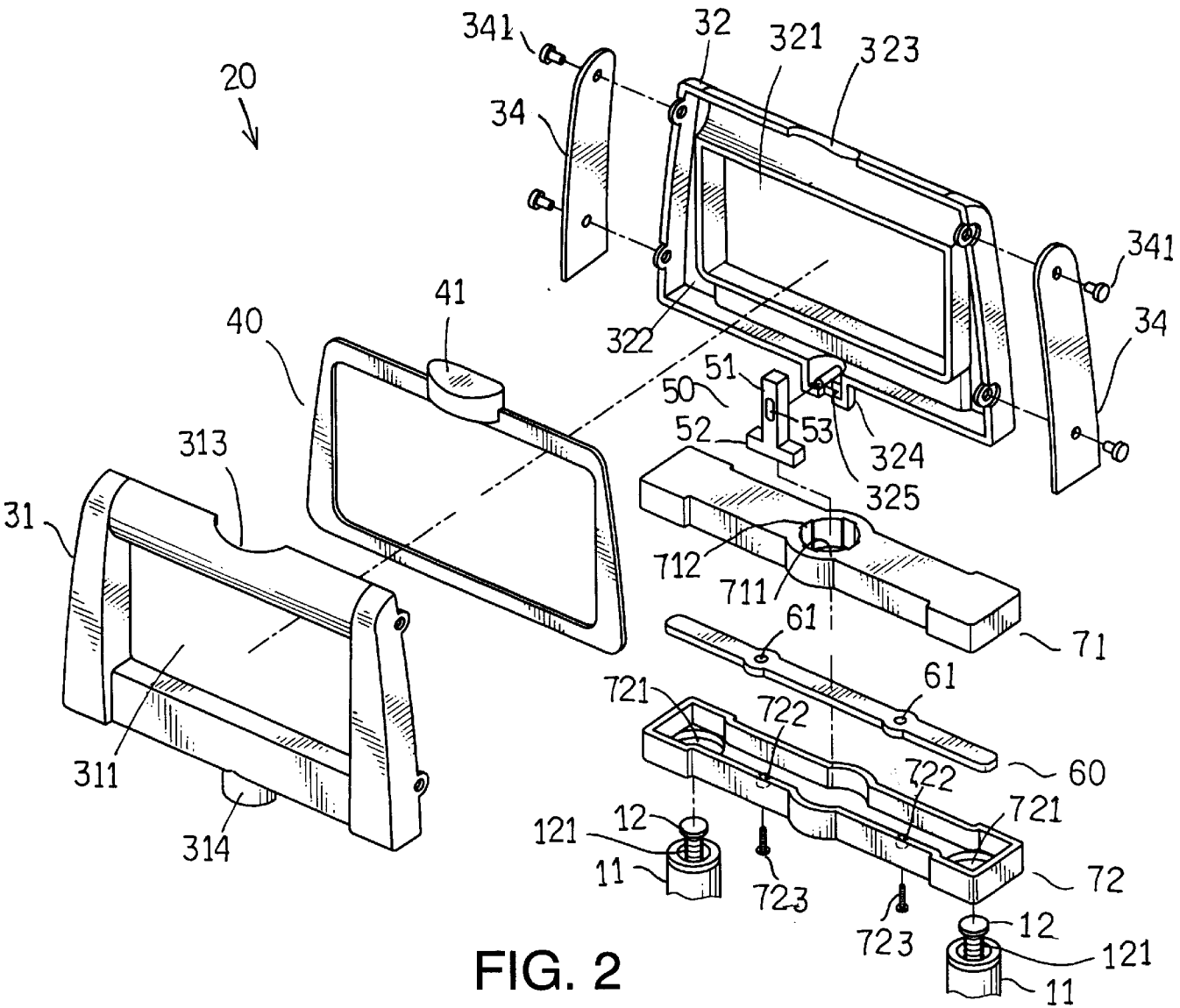
FIG. 2 is an exploded view of the invention.
Figure 3:
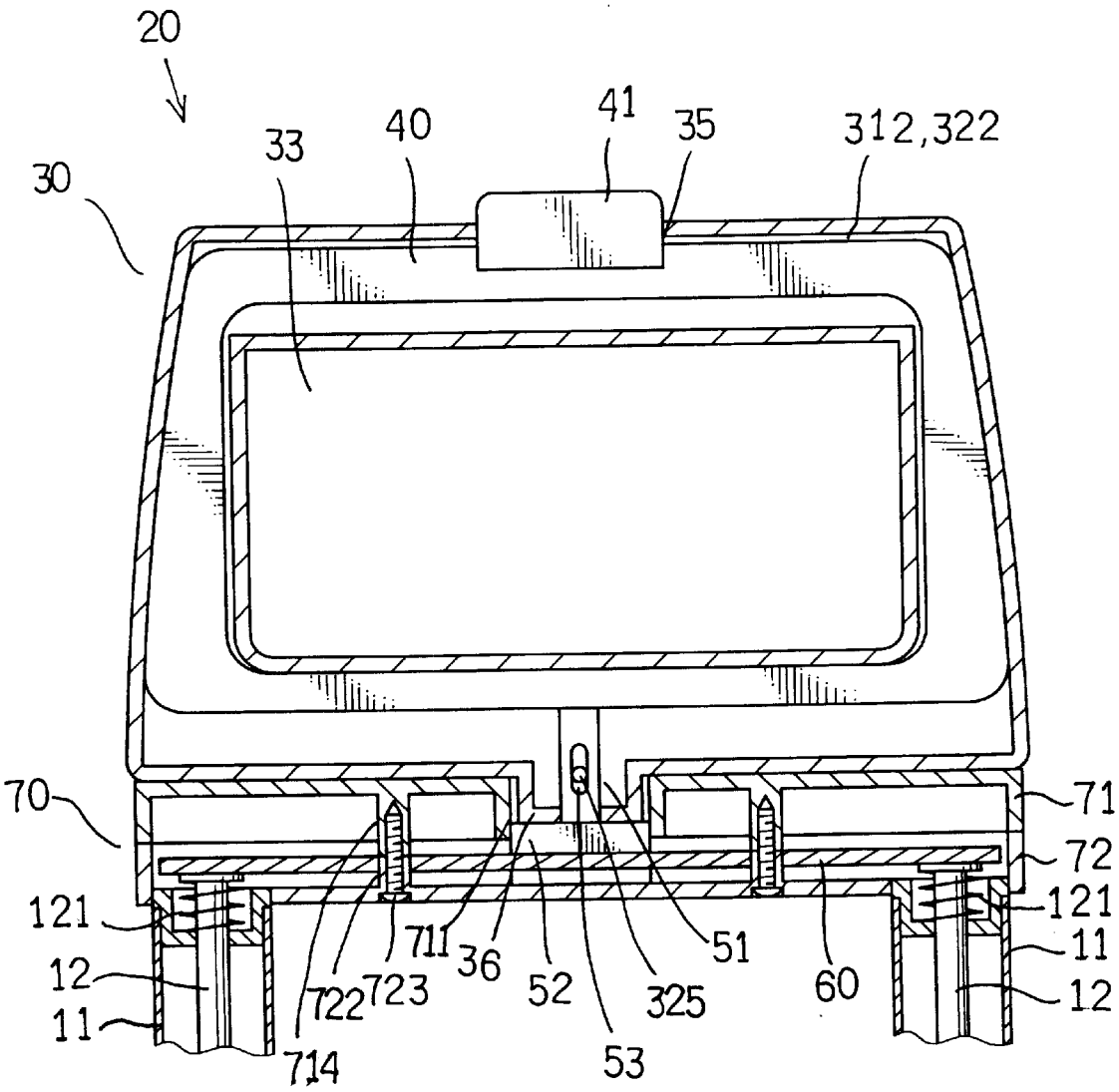
FIG. 3 is a sectional view of the invention.
Figure 4:
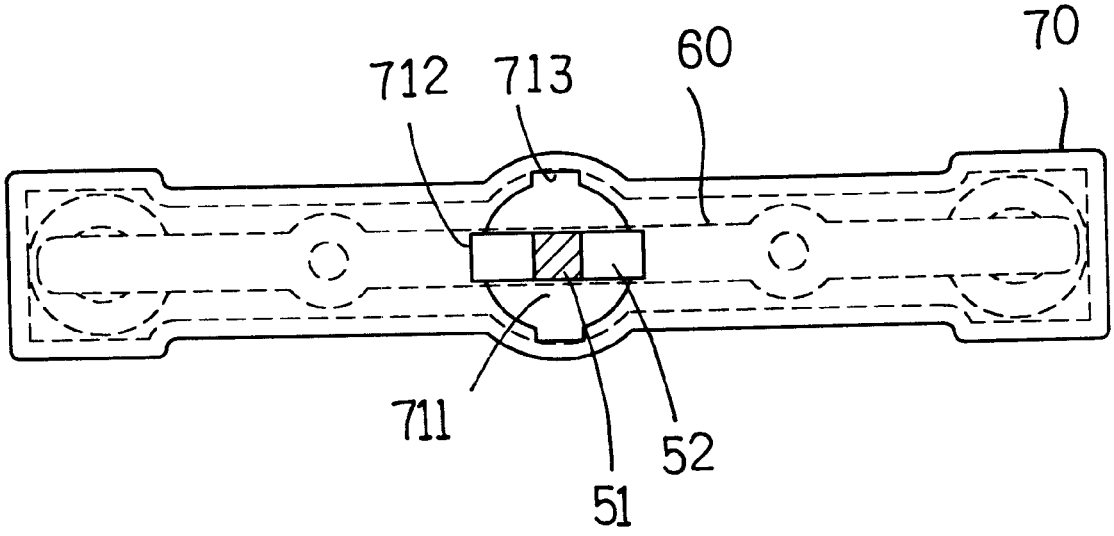
FIG. 4 is a top view of the invention.

Referring to FIGS. 1 through 4, the invention mainly includes a handle 20 bridging the top ends of two pulling bars 11 of a luggage 10. The handle 20 can control a control element of the pulling bars 11 to extend or retract the pulling bars 11 (such a technique is known in the art, and forms no part of the invention, thus will be omitted). The handle 20 includes a front frame 31 to couple with a rear frame 32 to form a handle section 30. In the handle section 30, there is a depressing member 40 which has a center on the bottom to contact a push stem 50. The push stem 50 is housed in an anchor seat 70 which consists of an upper seat 71 and a lower seat 72. In the anchor seat 70, there is a depressing plate 60.

In the handle section 30, the front frame 31 and the rear frame 32 are similarly formed with a same exterior shape, and have respectively an opening 311, 321 in the center to couple together for forming a grip section 33. The front frame 31 and the rear frame 32 further have respectively a channel 312, 322, formed in the interior around the periphery thereof to house the depressing member 40. At the center of the top end of the front frame 31 and the rear frame 32, there are respectively an indented arch 313, 323 to couple together for forming an aperture 35. At the center of the bottom of the front frame 31 and the rear frame 32, there are respectively a semi-circular jutting stub 314, 324 which may be coupled together to form a coupling strut 36. In the jutting stub 324 of the rear frame 32, there is a retain pin 325. When the frames 31 and 32 are coupled together to form the handle section 30, two fasten plates 34 may be attached to two sides of the handle section 30 and may be fastened to the frames 31, 32 by means of screws 341 for coupling the frames 31 and 32 securely.

The depressing member 40 is housed in the channels 312, 322 of the handle section 30, and has a push button 41 located at the center of the top end thereof. The push button 41 is housed in the aperture 35 of the handle section 30 and extended outside thereof.

The push stem 50 includes an upright bar 51 and a transverse bar 52 attached to the bottom of the upright bar 51 to form an inverse T shape. The transverse bar 52 has two ends forming wedge sections. The upright bar 51 further has a slot 53 formed there on for holding the retain pin 325 of the handle section 30.

The depressing plate 60 is an elongated element which has a pair of through bores 61.

The upper seat 71 and lower seat 72 of the anchor seat 70 have a similar exterior shape. The upper seat 71 has a retain trough 711 formed in the center on the top section to couple with the coupling strut 36 of the handle section 30. The retain trough 711 has two retain slots 712, 713 engageable with the two wedge sections of the transverse bar 52. The lower seat 72 has a pair of openings 721 formed on two ends thereof to allow control bars 12 of the element to pass through. The upper and lower seat 71, 72 further have respectively a pair of corresponding struts 722, 714 to couple with the bores 61 of the depressing plate 60. The upper seat 71 and the lower seat 72 may be fastened together by means of screws through the struts 722 and 714.

Figure 5:
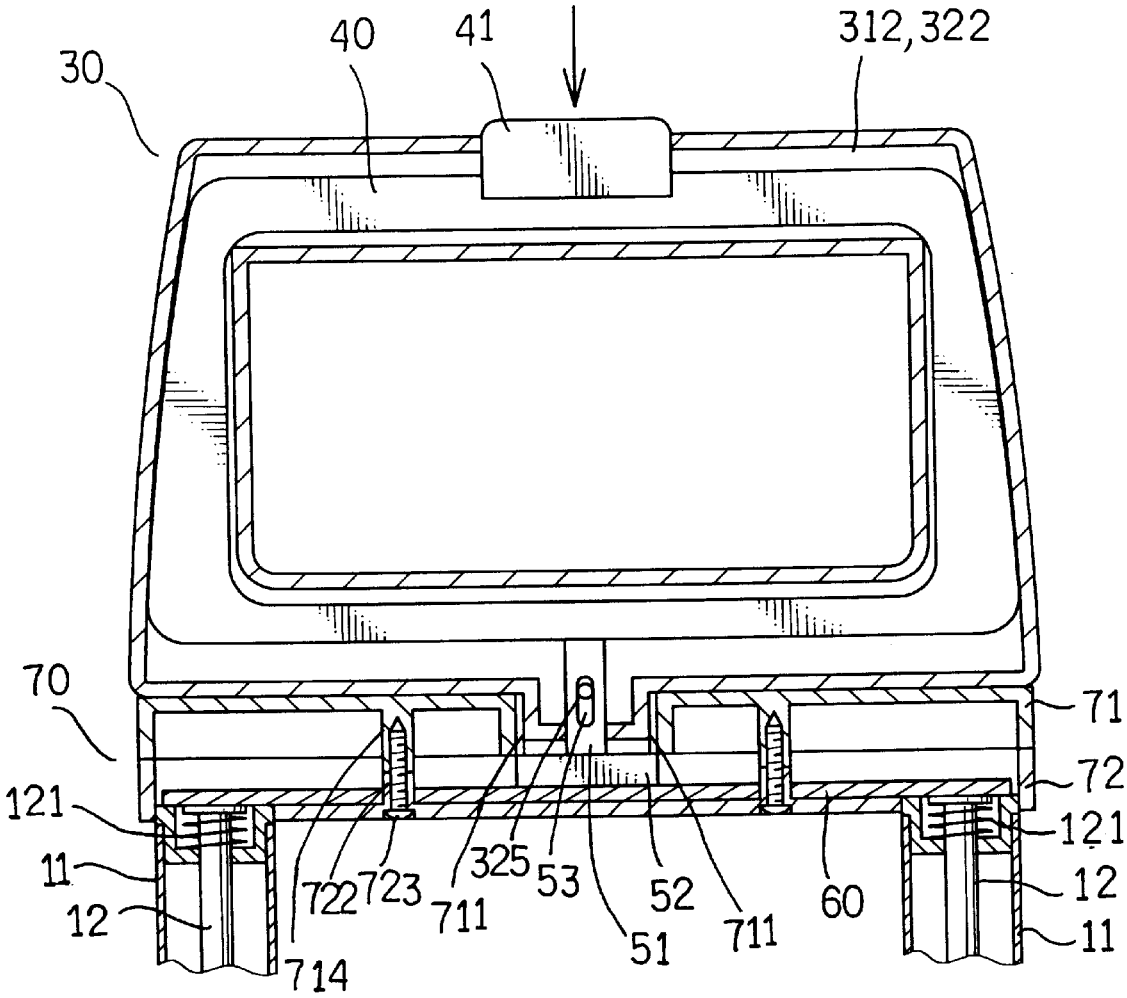
FIG. 5 is a schematic view of the invention in use.
Figure 6:
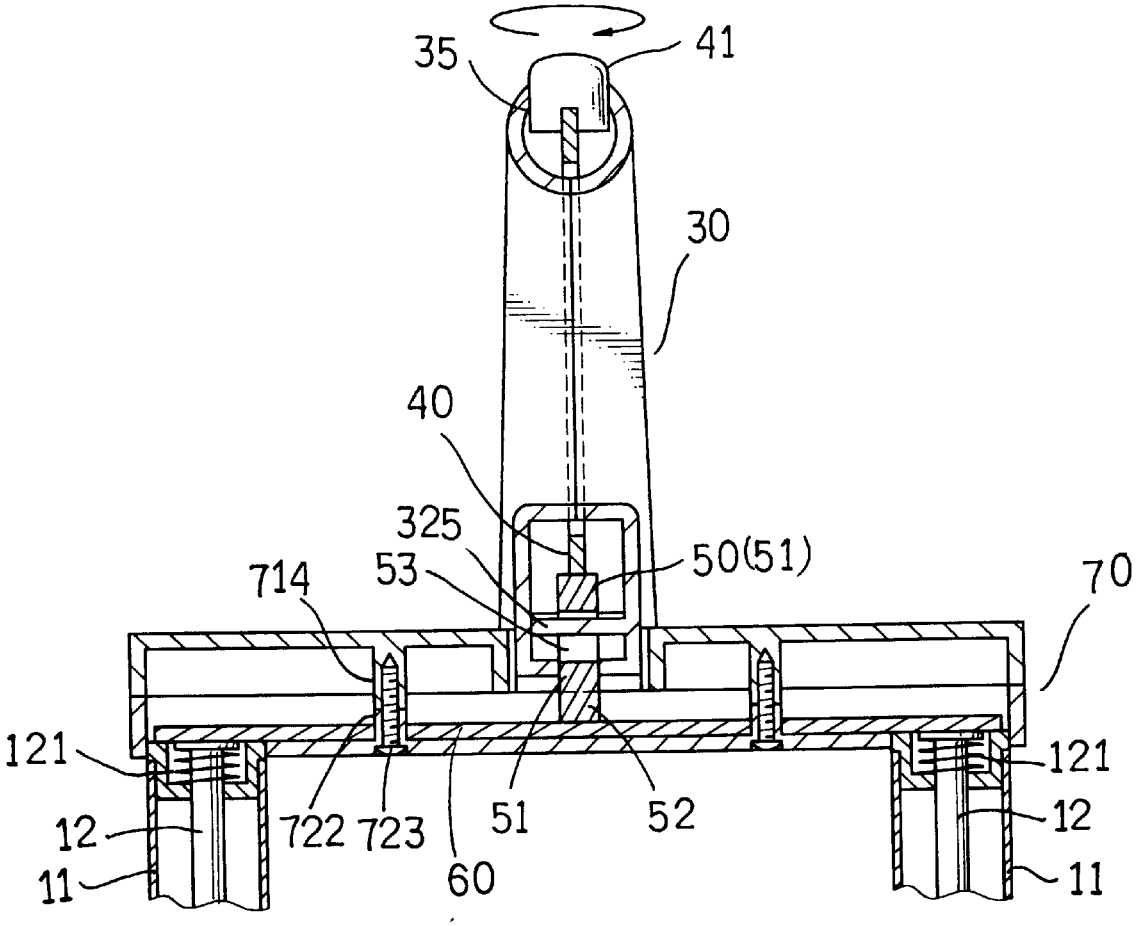
FIG. 6 is a schematic view of the invention for adjusting angles.
Figure 7:
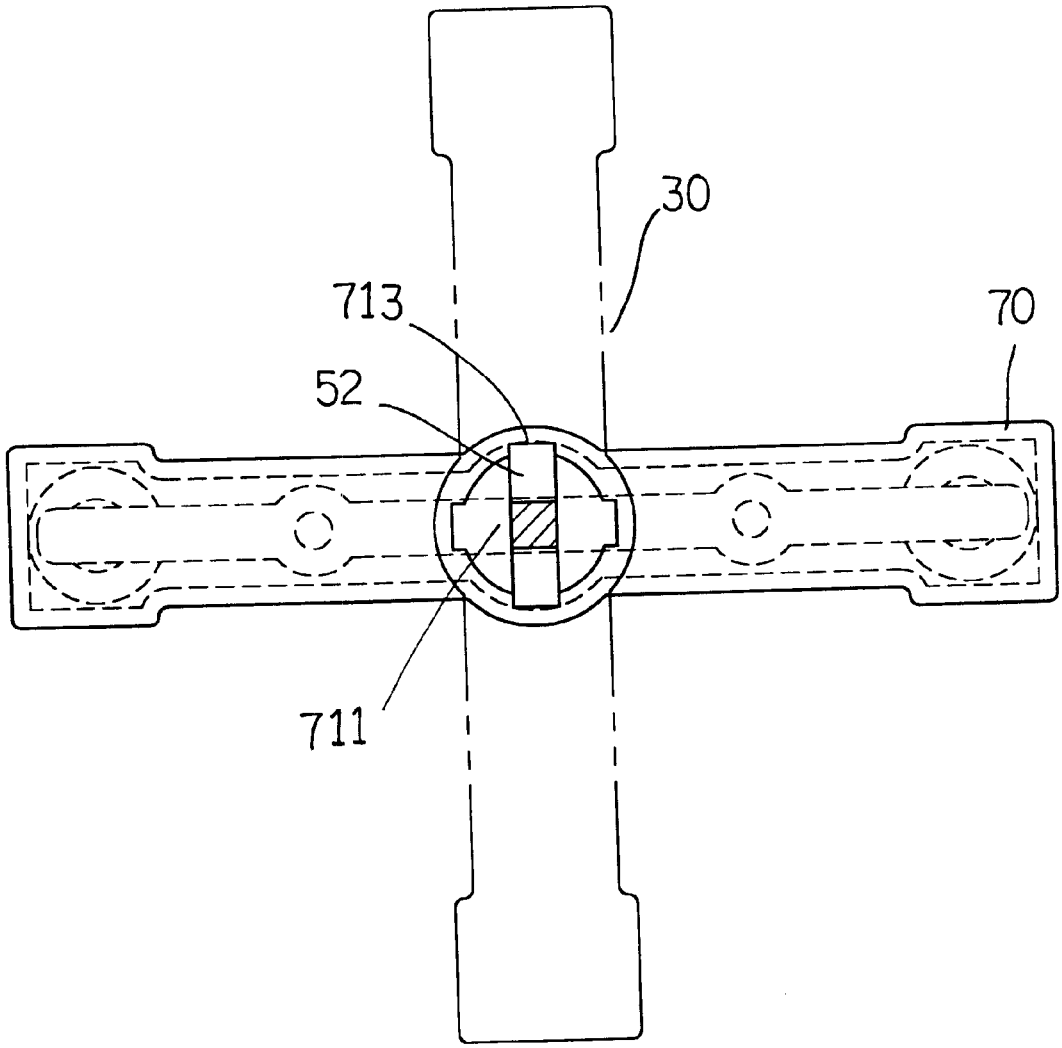
FIG. 7 is a top view of the invention at various adjusting angles.

When in use for adjusting the height of the pulling bars 11 of the luggage 10 (as shown in FIG. 5), users may do so by following, general operation procedures, i.e. depress the push button 40 to move the push stem 50 downwards. The depressing plate 60 will be pushed downwards and depress the control bars 12 thereby adjust the height of the pulling bars 11 (the depressing movement of the control bars 12 is a technique known in the art, thus will be omitted). Referring to FIGS. 5 and 6, when there is a desire to adjust the angle of the handle 20, depress the push button 41 of the depressing member 40 to move the push stem 50 downwards, the wedge sections of the transverse bar 52 will be moved away and disengaged from the retain slots 712 of the retain trough 711, then the handle section 30 may be turned and adjusted to a selected angle. Then release the depressing member 40, the control bars 12 are free from the external force and will be pushed to their original positions by springs 121. The depressing plate 60 will also be moved to its original position, and the push stem 50 will be moved upwards and engaged with another set of the retain slot 713 (as shown in FIG. 7) without sliding downwards. The embodiment shown in the drawings has two pairs of retain slots 712, 713 in the retain trough 711 for adjusting the handle in parallel with or normal to the luggage.

Figure 8:
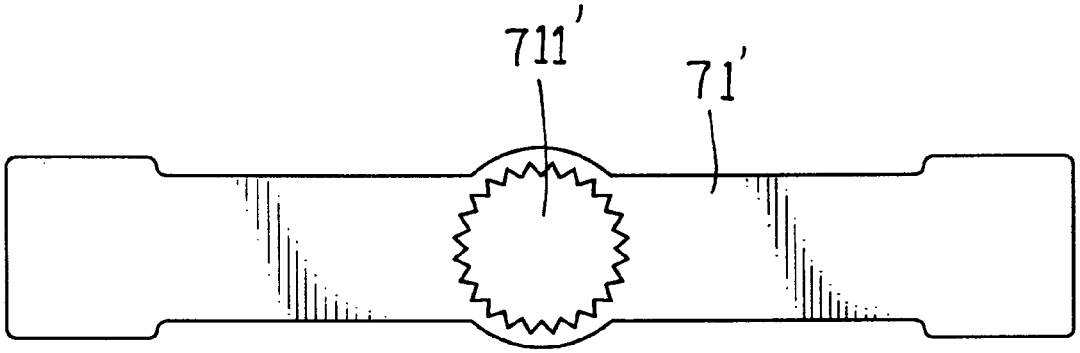
FIG. 8 is a schematic top view of another embodiment of the invention.

Referring to FIG. 8 for another embodiment of the invention, the retain trough 711' in the upper seat 71' may be a spline bore to allow the handle turning and anchoring in a multiple-stage manner. The wedge section of the push stem also has a spline profile to match and engage with the spline bore.

By means of aforesaid constructions, the handle of luggage or trunks can be turned and adjusted to an angle desired, thus can overcome the disadvantages of the conventional luggage or trunks.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

I claim:

1. A handle structure for adjusting directions, comprising:

a handle located on a top section of a luggage including a front frame and a rear frame, the front frame and the rear frame being coupled to form a handle section, the handle section having a depressing member located therein, the depressing member having a bottom section which has a center to contact a push stem which is formed in an inverse T shape; and an anchor seat located below the handle section for housing the push stem, the anchor seat including an upper seat and a lower seat coupling with each other, the upper seat having a retain trough to engage with the push stem;

wherein the depressing member is depressible downwards to make the push stem disengaging from retain slots formed in the retain trough of the anchor seat for turning the handle, and when the depressing member is released after the handle was turned, the push stem is engaged with the retain trough.

2. The handle structure of claim 1, wherein:

the front frame and the rear frame of the handle section have substantially a same exterior shape and have respectively an opening in the center thereof to couple together for forming a handgrip, and a channel in the interior around the periphery thereof for housing the depressing member, the front frame and the rear frame further have respectively an indented arch formed at the center of a top end thereof to couple and form an aperture, and have respectively a semi-circular jutting stub located at the center of a bottom end to couple together and form a coupling strut, the jutting stub of the rear frame having a retain pin, the front frame and the rear frame being coupled to form the handle section;

the push stem has an upright bar which has a slot for coupling the retain pin of the handle section and a bottom section forming a wedge section; and the upper seat and the lower seat of the anchor seat have substantially a same exterior shape, the upper seat having a retain trough formed in the center thereof to house the coupling strut of the handle, the retain trough having the retain slots to engage with the wedge section of the push stem, the lower seat having two sides each having an opening to allow control bars of a control element to pass through, the upper seat and the lower seat further have respectively a pair of struts corresponding to each other to engage with a screw for fastening the upper seat and the lower seat together.

3. The handle structure of claim 1 or 2, wherein the anchor seat has a depressing plate which has two ends located above the openings of the lower seat to contact the control bars of the control element.

4. The handle structure of claim 2, wherein the retain trough has two or more sets of the retain slots to engage with the wedge section of the push stem.

5. The handle structure of claim 2, wherein the retain trough is a spline bore to provide a multiple-stage anchoring and positioning effect, the wedge section of the push stem having a spline shape to match and engage with the retain trough.

* * * * *